US006082391A

United States Patent [19]

Thiebaud et al.

[11] Patent Number: 6,082,391

[45] Date of Patent: Jul. 4, 2000

[54] DEVICE FOR HYBRID RISER FOR THE SUB-SEA TRANSPORTATION OF PETROLEUM PRODUCTS

[75] Inventors: François Thiebaud, Breuillet; Vincent Alliot, Cruet Montmellian, both of France

[73] Assignees: Stolt Comex Seaway, Marseille; Doris Engineering, Paris, both of France

[21] Appl. No.: 09/148,444

[22] Filed: Sep. 4, 1998

[30] Foreign Application Priority Data

Sep. 12, 1997 [FR] France ..... 97/11608

[51] Int. Cl.[7] ..... E21B 17/01

[52] U.S. Cl. ..... 137/236.1; 405/224.1

[58] Field of Search ..... 137/236.1, 580; 405/224.1–224.3; 441/4, 5

[56] References Cited

U.S. PATENT DOCUMENTS

| | | | |
|---|---|---|---|
| 2,895,301 | 7/1959 | Casagrande et al. | 405/224.1 |
| 3,263,641 | 8/1966 | Stimson | 114/206 |
| 3,372,409 | 3/1968 | Manning | 137/236.1 |
| 3,535,883 | 10/1970 | Manning | 137/236.1 |
| 3,756,293 | 9/1973 | Adler et al. | 137/236.1 |
| 3,782,458 | 1/1974 | Slack | 141/387 |
| 3,834,432 | 9/1974 | Lilly, Jr. et al. | 137/236.1 |
| 3,880,105 | 4/1975 | Bryant | 114/206 R |
| 3,928,982 | 12/1975 | Lacroix | 405/224.1 |
| 4,031,919 | 6/1977 | Ortloff et al. | 137/799 |
| 4,529,334 | 7/1985 | Ortloff | 405/224.1 |
| 4,567,843 | 2/1986 | d'Hautefeuille | 114/230 |
| 4,693,637 | 9/1987 | Suzuki et al. | 405/224 |
| 4,696,601 | 9/1987 | Davenport | 405/202 |
| 4,793,737 | 12/1988 | Shotbolt | 405/224.1 |

FOREIGN PATENT DOCUMENTS

| | | |
|---|---|---|
| 2290345 | 6/1976 | France . |
| 2130623 | 6/1984 | United Kingdom . |
| 2180809 | 4/1987 | United Kingdom . |
| 9730887 | 8/1997 | WIPO . |

*Primary Examiner*—Charles R. Eloshway
*Attorney, Agent, or Firm*—Ladas & Parry

[57] ABSTRACT

A device for transporting petroleum products in deep waters from the seabed up to a floating or semi-submersible surface structure wherein at least one rigid and straight hybrid riser extends vertically. The hybrid riser has a rigid central hollow tubular structure surrounded by a cylindrical block of syntactic material which provides buoyancy and thermal insulation for the riser. A plurality of rigid pipelines are embedded in the syntactic material and surround the central tubular structure for receiving petroleum products from wells on the sea bed. The bottom of the riser is connected to a suction anchor at the sea bed. A submerged float is fixed to the top of the riser and exerts an upward vertical force thereon. Flexible pipelines connect the rigid pipelines in the riser to the floating or semi-submersible structure.

11 Claims, 15 Drawing Sheets

1
2
3
4
5
7
8
9
11
18
19
20
A
B 1
5
2

3
42
7
26
3
4
42
42
B
26
9
40
40
41
8
39
11a
20
11b
40
40
11a
39
11a
11a
11b
11a
20
20

DEVICE FOR HYBRID RISER FOR THE SUB-SEA TRANSPORTATION OF PETROLEUM PRODUCTS

The subject of this invention is a device with a hybrid riser for the sub-sea transportation of petroleum products.

The technical sector of the invention is the field of the construction of installations for the extraction of petroleum products from the sub-sea sub-soil.

The present invention relates more particularly to a pipeline system or device for transporting petroleum products extracted from one (or more) well(s) drilled in the sub-sea sub-soil to a floating or semi-submersible (surface) structure, particularly to a floating production, storage and off-loading (F.P.S.O.) vessel.

The invention is particularly applicable to that part of the pipeline which extends from the surface of the sea bed up to the floating or semi-submersible structure.

One objective of the present invention is to provide such a device which is well suited to great depths, particularly depths of 750 meters or more, and to its method of installation.

In order to raise to the surface petroleum products which have been extracted in deep waters, it is known practice to make use of rigid pipelines, particularly made of steel, whereas for raising products which have been extracted from shallower waters, it is known practice to make use of flexible or deformable pipes.

In particular, the use in deep waters of risers which extend more or less vertically and are more or less rigid is known.

Such risers, sometimes known as hybrid risers, may consist according to the invention—as depicted diagrammatically in cross-section in FIG. 9—of a vertical bundle of steel pipes which are, at least in part, supported by buoyancy means; such risers comprise a straight tubular central structure made of steel which extends vertically and may be filled with air in order to play a part in buoyancy, and which is surrounded by syntactic buyoancy composite material over at least part of its height, for example in the form of hollow cylindrical modules stacked (and/or strung) around the central tubular structure; this syntactic material contributes to the buoyancy; production pipelines transporting the extracted products to the surface and service pipelines transporting fluids and sometimes power towards the sea bed extend around and along the length of the central structure, through the syntactic material; these lengths of peripheral pipeline for vertical transport are connected at their lower end to essentially rigid and metal pipelines running along the sea bed, down to the extraction well, and are connected at their upper end to lengths of flexible pipeline extending up to the floating structure, generally via gooseneck connections.

Such structures of risers in which the transport pipelines are surrounded by syntactic material are particularly beneficial for raising petroleum products from the sea bed because the syntactic material acts as thermal insulation, thus limiting the cooling of the "crude" by the cold sea water, and thus limits the formation of undesirable products (paraffin, hydrates) in the pipes.

Because these risers, which extend up to within a few tens of meters from the surface, are very long (tall), that is to say several hundreds of meters long, it is important that their deformation (curvature) resulting in particular from the hydrodynamic action of the currents and their positioning under the water be controlled, so as to keep the displacement of the upper end of the risers to within acceptable limits; failing this, excessive loadings on the flexible pipelines connecting these risers to the floating structure may result; impacts between two risers located close together, and/or undesirable overlapping (or intertwining) of the riser and other string-like structures (umbilical cables, other risers for example) located close to it may also result.

The problem posed consists, in particular, in proposing a highly effective system for anchoring the base of the riser to the sub-sea sub-soil.

One objective the invention consists in proposing a system for attaching the base of the riser to the sub-sea sub-soil which is easy and inexpensive to implement at great depth.

Another objective of the invention consists in proposing a system for attaching the base of the riser to the sub-sea sub-soil which facilitates the connection of the riser to the sub-sea sub-soil and, if necessary, its future disconnection with a view to the riser being re-used in another place.

Another objective of the invention consists in proposing a system for anchoring the base of the riser to the sub-sea sub-soil which allows connection between anchoring means and the base of the riser which may be either articulated or fixed.

Another objective of the invention consists in proposing a system for anchoring the base of the riser to the sub-sea sub-soil which is of low cost (in terms of hardware and operation), so that it can be abandoned after use.

According to a first aspect of the invention, the riser is fixed to the sub-soil by a friction anchor; for this, the anchor has a large (and preferably ribbed) contact area with the sub-soil.

According to another aspect, the riser is fixed to the sub-soil by a gravity anchor; for this, the anchor has a great mass (several tonnes or tens of tonnes at least).

Preferably, in both cases, the anchor has a more or less cylindrical shape, one base of which is open.

In the case of the friction anchor, the anchor may essentially consist of an elongate shell with a ribbed cylindrical wall, of polygonal cross-section, which is closed (hermetically) at one end, by a wall, for example a planar wall, in the shape of a disc of polygonal contour which, in the position of use (of anchorage) forms the upper part; the anchor is installed as follows: the anchor is placed on the sea bed via the open face provided at the bottom end of the anchor; the internal space delimited by the walls of the anchor is partially evacuated (by pumping or sucking out water using a pump) and the anchor then sinks (more or less vertically) into the soil under the effect of the hydrostatic pressure applied to it, until its cylindrical lateral walls have fully (or at least substantially) entered the soil; in general, the bottom end of the anchor will be sunk at least 5 meters into the soil, and usually will be sunk of the order of 10 to 25 meters. Bearing in mind the large area (of the order of 100 to 1000 $m^2$) of the internal face and of the external face of the walls of the anchor which are sunk into the soil, significant resistance to pulling out (of the order of several tens or hundreds of tonnes) is obtained, because of the friction forces exerted by the sub-sea sub-soil on these walls; furthermore, because the (sea-water-filled) residual cavity, delimited by the lateral or peripheral walls of the (bell-shaped) anchor and by the upper wall, is isolated more or less hermetically from the sea water surrounding the anchor, an additional resistance to pulling out is obtained as a result of a suction or suction-cup effect.

According to another aspect of the invention the riser for transporting petroleum products is attached by an anchor which is installed by a method in which the anchor is sunk into the sub-sea sea-bed by creating an under pressure when partially evacuating the cavity delimited by the soil and by the upper part of the bell-shaped anchor.

In the case of the use of a gravity anchor, this anchor may essentially consist of a cylindrical shell of polygonal cross-section, the upper base of which is open and the lower base of which is at least partially closed.

Such an anchor forms a container capable of holding a sizeable amount (several hundreds of tonnes) of a heavy bulk material such as a metal ore or residue from the processing of such an ore.

According to another aspect of the invention the riser for transporting petroleum products is attached by an anchor which is intalled by a method in which a heavy material is deposited under gravity in the shell of the anchor by conveying this material through the hollow central tubular structure of the riser.

The numerous advantages afforded by the invention will be better understood through the following description which refers to the appended drawings, which illustrate, with no implied limitations, some preferred embodiments of the invention.

In the drawings, unless otherwise indicated, elements which are identical or similar bear the same references from one figure to another.

Figures 5, 5A, 5B:
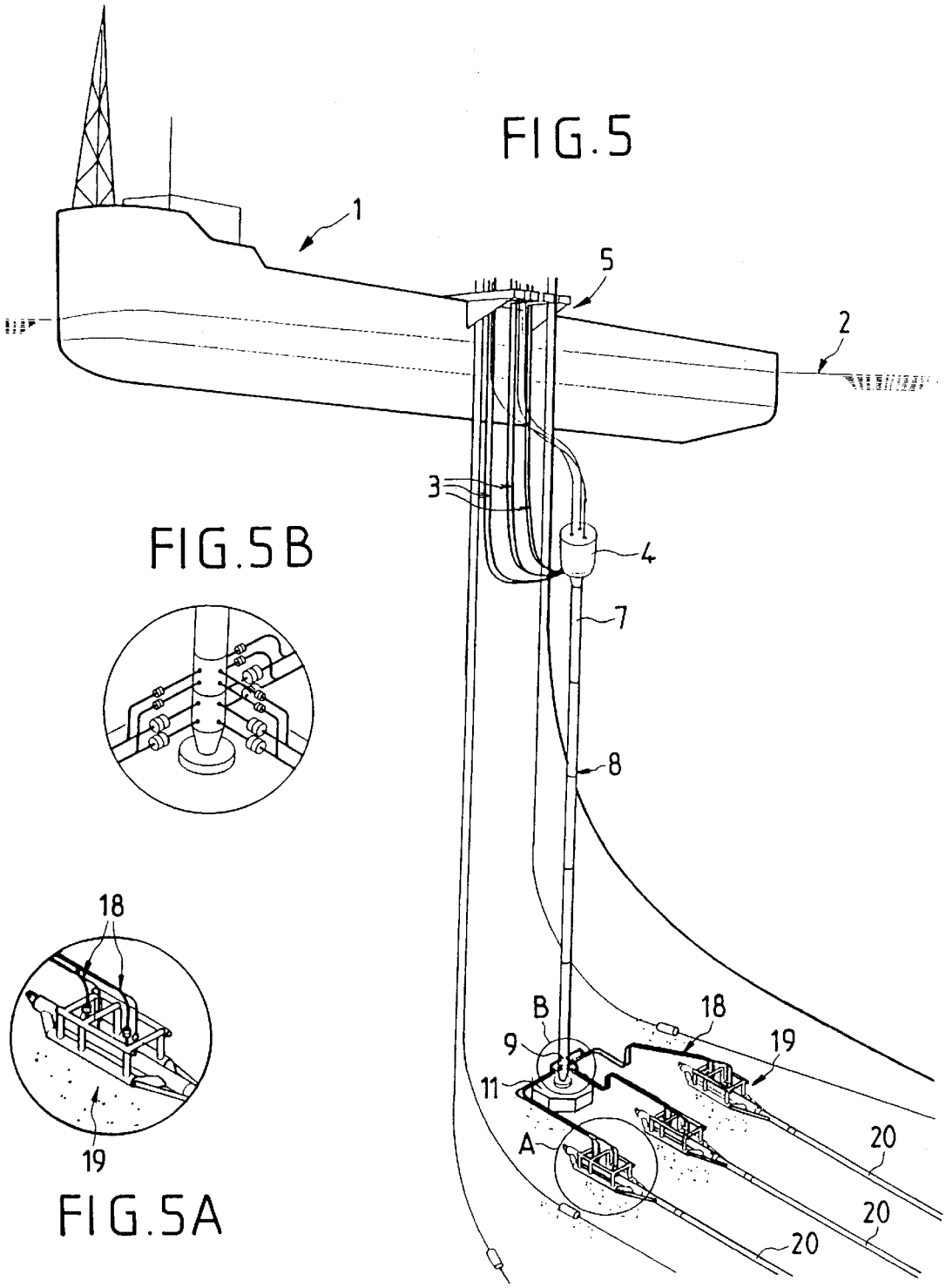
FIGS. 5 to 7 illustrate, in diagrammatic perspective, three alternative forms of the invention.
Figures 6, 6A, 6B:
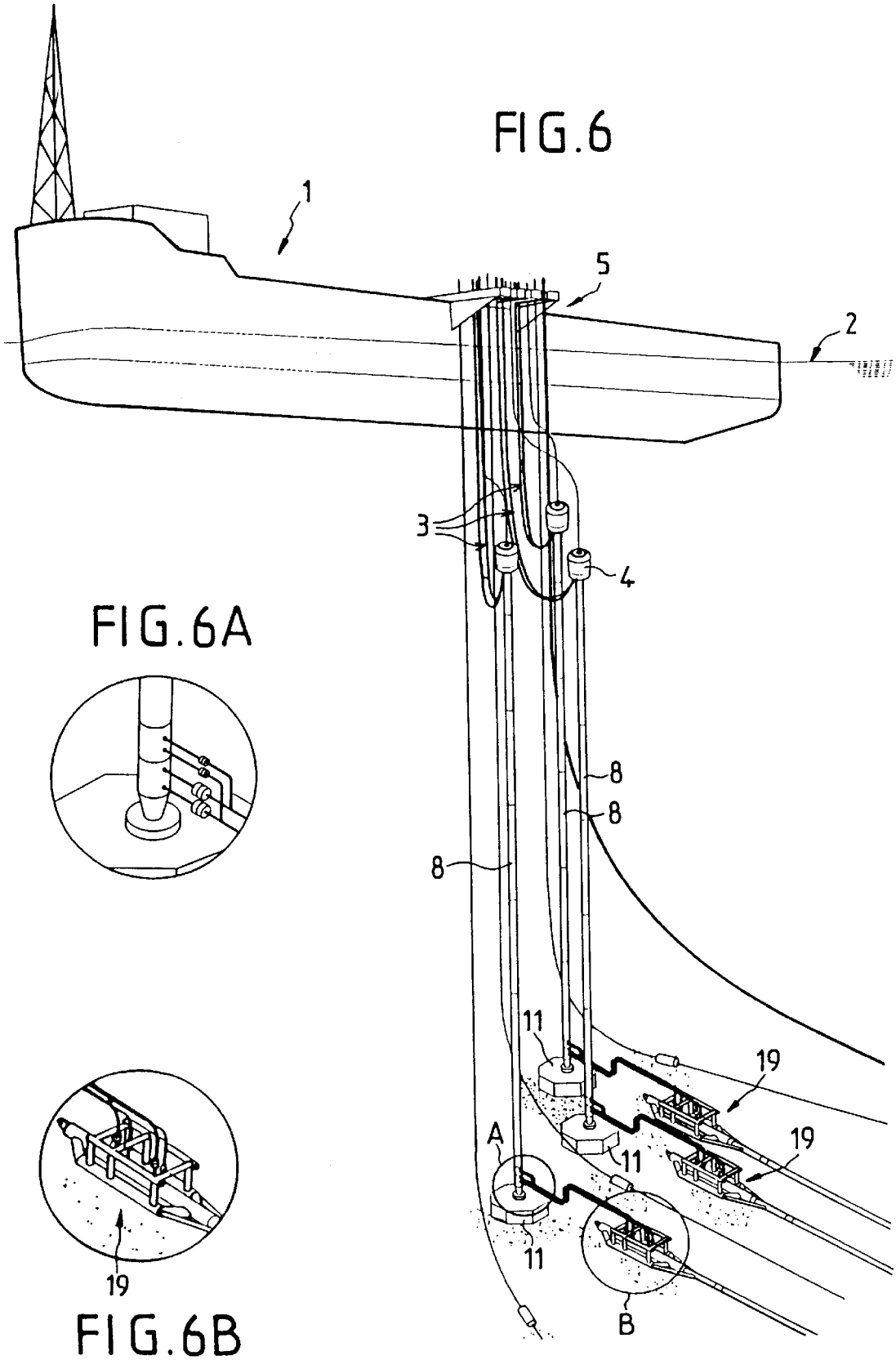
Figures 7, 7A, 7B:
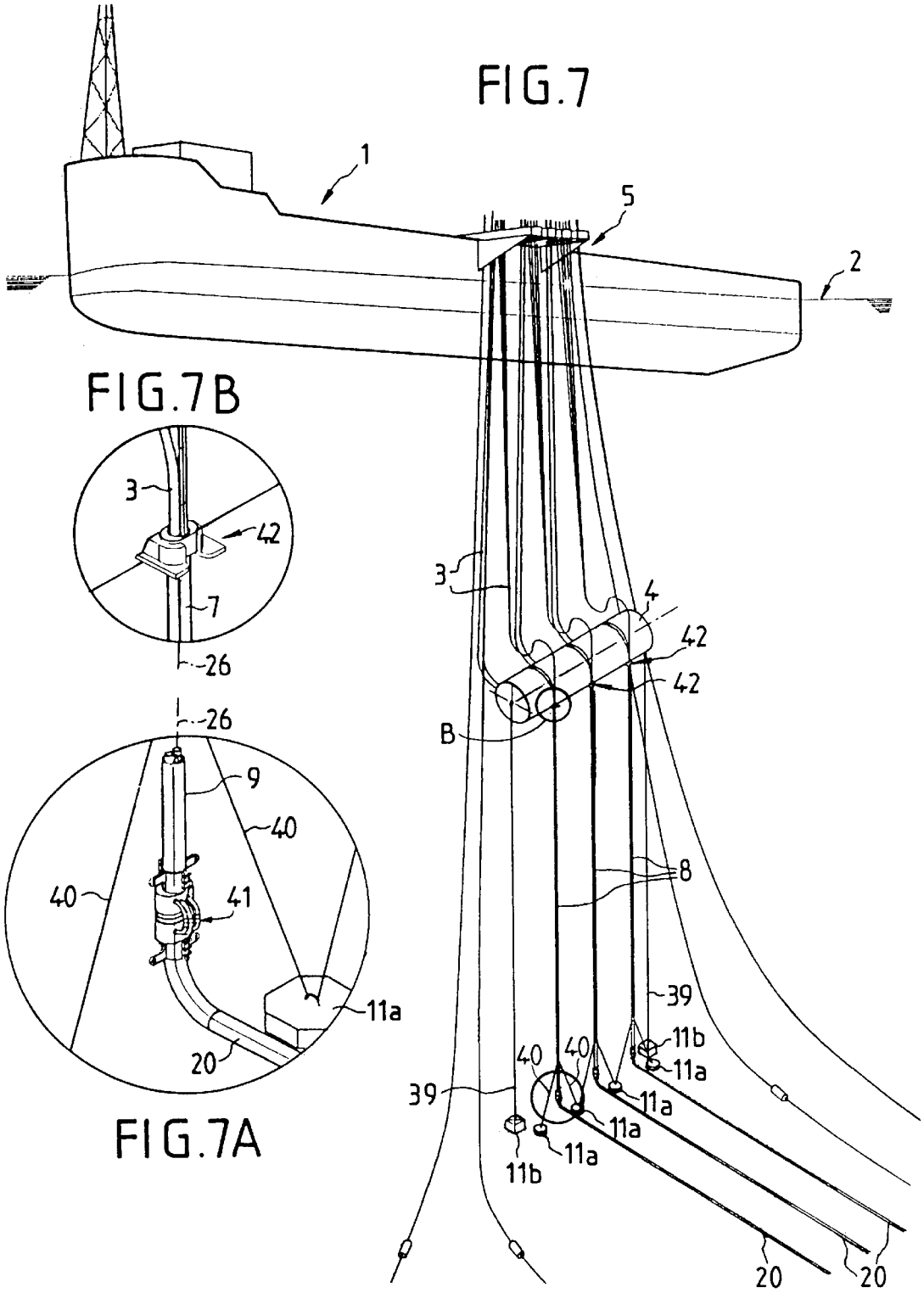

FIGS. 5*a,* 5*b,* 6*a,* 6*b,* 7*a* and 7*b* are detail views A and B, on an enlarged scale, of FIG. 5 to 7 respectively.

Figure 8:
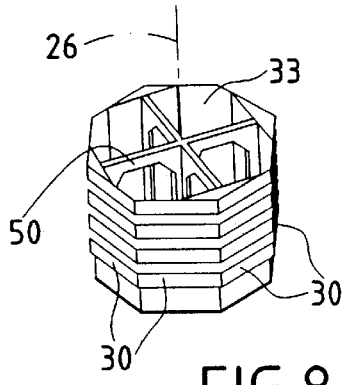

FIG. 8 illustrates, in a diagrammatic perspective view, a preferred embodiment of a structure which forms part of a gravity anchor for attaching a riser in accordance with the invention.

Figure 9:
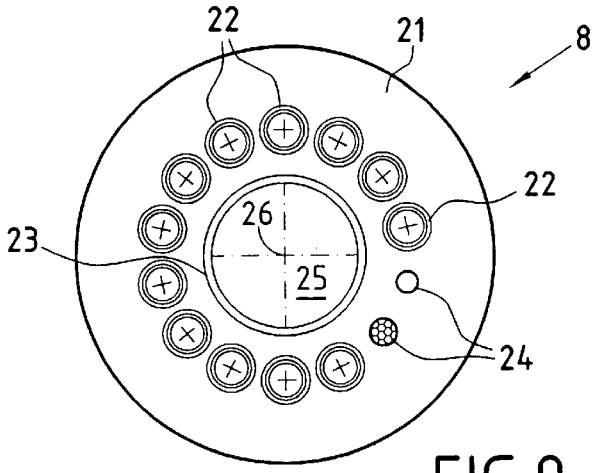

FIG. 9 illustrates in a diagrammatic cross-sectional view, the structure of a rigid and insulated riser.

With reference to FIG. 9, the riser 8 comprises a tubular central structure 23 consisting of a steel tube delimiting a cylindrical cavity 25 which may be filled with air in order to contribute to the buoyancy of the riser and which may also be used for the transporting, and the dropping under gravity, of heavy materials which can thus be transported from the water surface (or from the top end of the riser which lies at a shallow depth) down to the sea bed which is in deep water, in order to fill the structure of a gravity anchor allowing the riser to be anchored.

Figure 1:
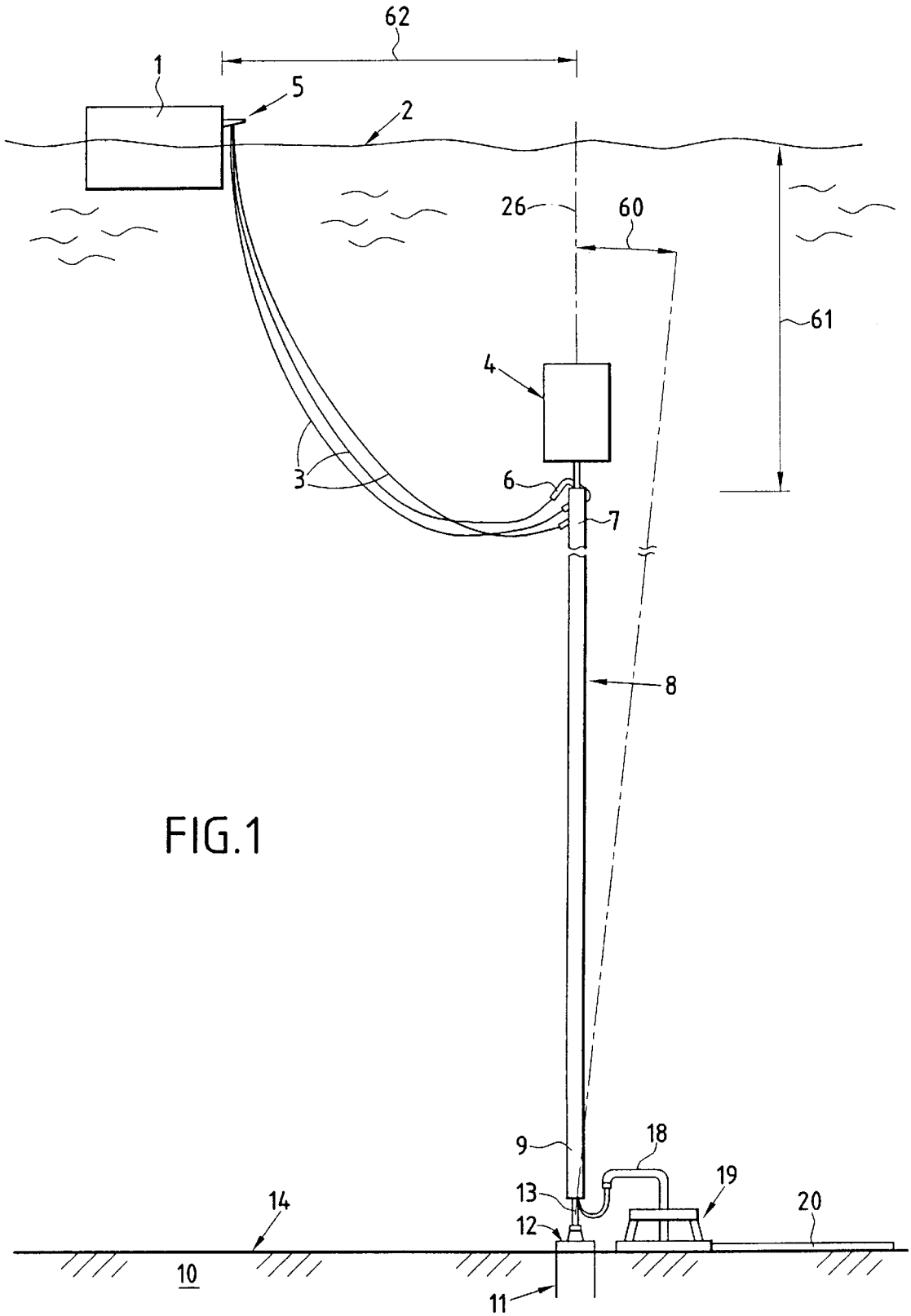
FIG. 1 illustrates, in diagrammatic side view, the main constituent parts of a device for transporting petroleum products in order to raise them from the surface of the sea bed to the water surface.

This central structure 23 is more or less straight, and has a longitudinal axis 26 extending, in the position of use, more or less vertically, as illustrated in particular in FIG. 1.

The central structure 23 is surrounded by more or less cylindrical blocks of syntactic material 21, inside which there extend tubes 22 and 24 parallel to the central tubular structure 23 and distributed around it, so that they are insulated by the syntactic material 21; the tubes 22, which for example are metal and rigid, are used to raise petroleum products extracted from the sub-sea sub-soil, while tubes or umbilical cables 24 are used to transport service fluids or electrical power, for example, to the sea bed.

With reference to FIGS. 1, 5 and 6 in particular, the riser 8 extends vertically in the direction of the axis 26, is attached at its bottom end 9 to a suction anchor 11 via mechanical means of connection 13, and is attached mechanically by its top end 7 to a float 4 such as a container full of air which also contributes to the buoyancy of the column, by exerting an upwards vertical force on it.

The pipelines for transporting petroleum products that the riser 8 comprises, are connected at their top end, via bent gooseneck pipes 6, to flexible pipelines 3 extending in a catenary curve between the top end 7 of the riser 8 and the floating (or semi-submerged) structure 1 at the surface 2 of the sea. The flexible pipe 3 are mechanically attached to the structure 1 by fastening means 5 illustrated diagrammatically in greater detail in FIGS. 5 to 7 in particular.

The said pipelines for transporting petroleum products are also connected, at the bottom end 9 of the riser 8, to the bundles of pipelines 20 which run along the surface 14 of the sea bed 10 (and which come from one or more extraction well(s)), as follows, illustrated, in particular, in FIGS. 1 to 3, 5 and 6:

The bottom end 22*a* of a pipeline 22 for transporting petroleum products is connected to a pipeline 18 forming a sleeve, itself connected to the end of a pipeline 20*b* forming part of the bundle 20 running along the surface 14 of the sea bed 10; the bundle 20 of pipelines may, for example, consist of two pipelines 20*b* for raising petroleum products and of two pipelines 20*a* for service fluids, especially gas or water, in order in particular to pressurize or maintain the system of pipelines; the ends of the portions 20*a,* 20*b* of the bundle 20 of pipelines are attached to a mechanical structure 19 forming a sled, which is equipped with runners 19*a,* which help it to slide along the sea bed 10 and which may be towed via a hook 19*b,* with which it is equipped, when the bundle 20 of pipelines is being installed on the sea bed prior to its connection to the riser.

Figure 2:
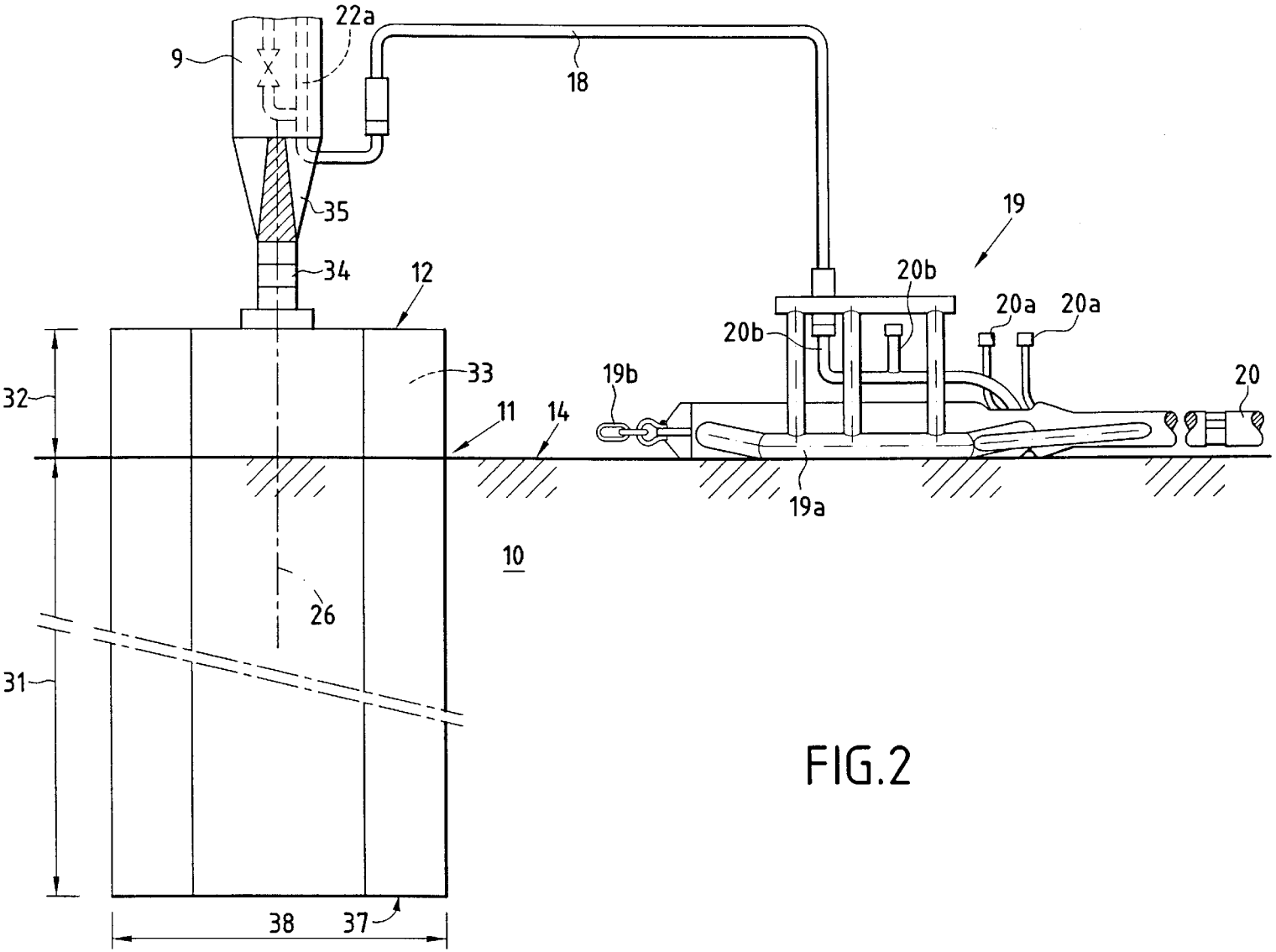
FIG. 2 illustrates, in diagrammatic side view, on an enlarged scale, an embodiment detail of a friction anchor and of the means of connecting it to the riser according to a preferred embodiment of the invention.
Figure 3:
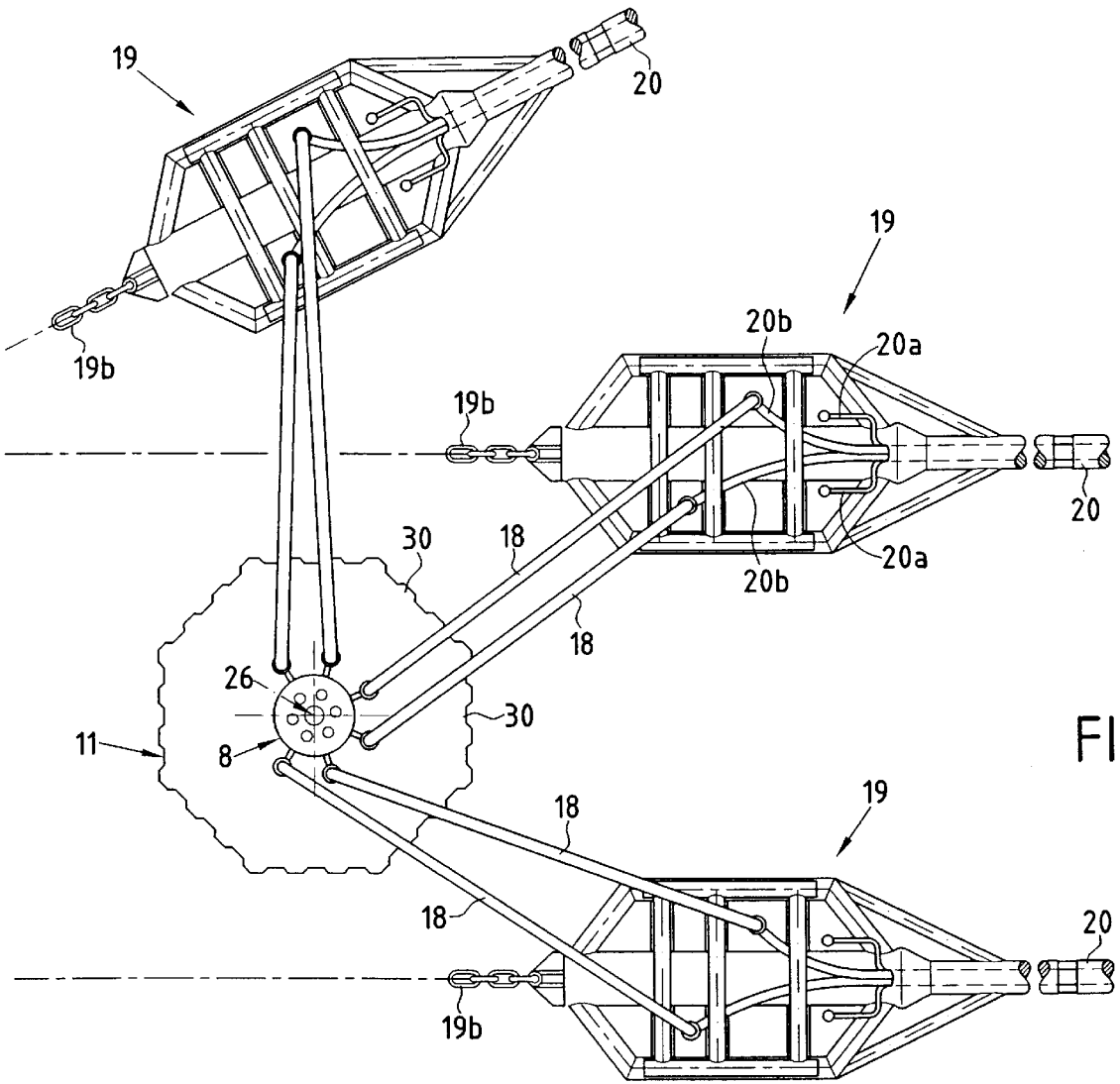
FIG. 3 illustrates, viewed from above, one embodiment of the invention, in which three bundles of pipelines running along the sea bed are connected to the base of a riser attached to the sub-soil by a friction anchor, and is essentially a view from above of the device of FIG. 2.

With reference to FIGS. 2 and 3 in particular, the friction anchor 11 used for attaching the base 9 of the riser to the sub-sea sub-soil 10 comprises a metal structure consisting of eight ribbed lateral facets 30 forming, when viewed from above as illustrated in particular in FIG. 3, a wall of octagonal cross-section, of cylindrical overall shape, of axis 26 which is vertical when in the position of use; the height of the lateral facets 30 of the structure of the anchor 11 allows these walls to be sunk to a depth 31 into the sub-sea sub-soil as illustrated in FIG. 2, for example of the order of 10 to 20 meters, the upper portion of the lateral walls 30 extending above the surface 14 of the bed 10 by a height 32, for example of the order of one or more meters; a horizontal upper wall 12, provided at the top end of the anchor 11 forms, with these side walls, a sort of bell which (when the anchor has been sunk into the sub-soil 10 as illustrated in FIG. 2), delimits with the surface 14 of the bed, a water-filled residual cavity 33; this makes it possible, through a suction-cup effect, to create a resistance of the anchor 11 to pulling out, which resistance adds to the resistance to pulling out that results from the significant friction forces exerted over the entire area of the facets or side walls 30 of the anchor sunk into the sub-soil 10; the diameter or width 38 of the anchor 11 is preferably of the order of several meters, for example of the order of 5 to 10 meters.

Figure 4:
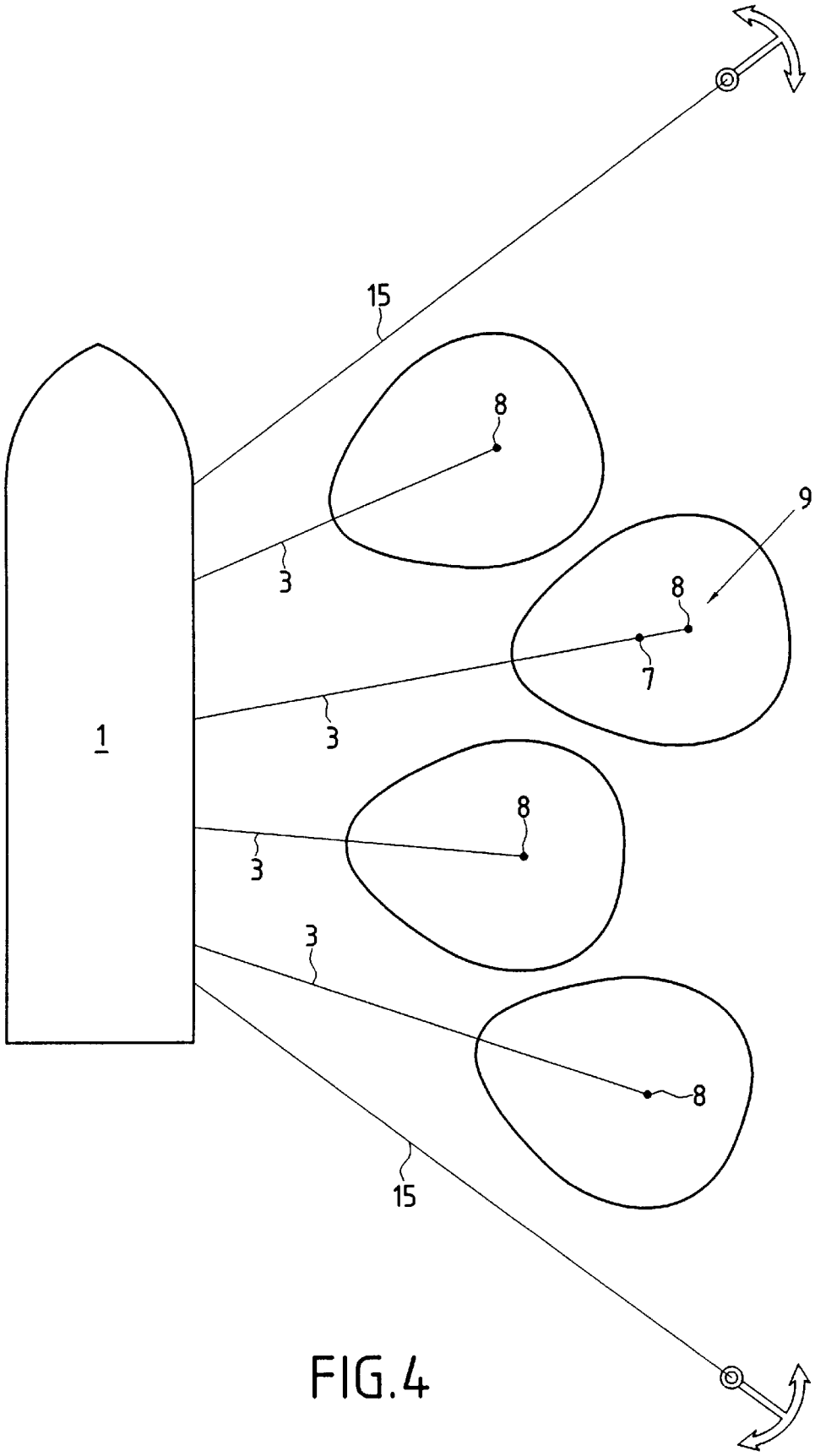
FIG. 4 illustrates in diagrammatic view from above, a floating production, storage and off-loading structure for petroleum products, its own anchoring means and its means of connection to four risers for transporting petroleum products.

With reference to FIG. 2 in particular, the base 9 of the riser is rigidly attached, for example by welding, to a reinforced tubular length 35, the bottom end of which is mechanically secured to a connector 34, itself mechanically secured to the planar horizontal top wall 12 of the structure of the anchor 11; such attachment by rigid connection makes it possible, for example to limit the displacements of the top end 7 of the riser 8 to within a cone of apex half-angle 60, of the order of 1 to 5 degrees for example, so as to limit the displacement of the said top end 7, in a horizontal plane, to a value of the order of one or several tens of meters, bearing in mind the significant length (or height) of this riser 8, which is, for example, of the order of 1000 to 2000 meters; this top end 7 of the riser 8 is, for example, located at a depth 61 of the order of several tens of meters, for example close to 100 meters, and the floating structure 1 is situated, for example, at a distance 62 from the vertical axis 26 of the riser 8, also of about 100 meters approximately; this makes it possible, with reference to FIG. 4 in particular, for several risers 8 relatively distant from one another to be connected by corresponding bundles of flexible pipelines 3, allowing a displacement of the said end 7 of each of the risers 8, without the latter knocking together or becoming intertwined; with reference to this figure, the structure 1 is positioned at the water surface by anchoring means such as anchoring lines 15 equipped at their end with anchoring means depicted symbolically by anchors.

Whereas, as illustrated in FIGS. 1, 2, 5 and 6 in particular, each riser 8 may be attached rigidly and in a more or less inset way into the sub-sea sub-soil by the friction anchors 11 or, as an alternative, by gravity anchors illustrated diagrammatically in FIG. 8, these risers may also, as illustrated in FIG. 7, be attached by connecting means allowing these risers a greater displacement, that is to say by more or less articulated connections, which, as illustrated in FIGS. 7 and 7*a,* may essentially be produced by lengths of metal cable 40, fixed by their first, upper end to collars or attachment means provided at the bottom 9 of the riser, on the one hand, and attached by their second end to friction anchors 11*a* identical or similar to those described above; in the embodiment illustrated in FIG. 7 and 7*a,* the base 9 of each riser 8 is attached to the sub-sea sub-soil by two friction anchors 11*a;* the three risers 8 illustrated in this figure, which use common anchors 11*a,* use a total of four anchors 11*a* for this attachment by cables 40; these risers 8 are placed in tension via their top end 7, by means of a common float 4 of essentially cylindrical shape of horizontal axis, to which they are attached by means 42 illustrated diagrammatically in greater detail in FIG. 7*b,* and constituting kinds of grippers; this float 4 is itself connected to the sub-soil 10 by friction anchors 11*b* sunk into the sub-soil in the same way as described earlier, the float 4 being connected to these two anchors lib by two cables 39, thus limiting the possible displacement of the float 4.

With reference to FIG. 7*a,* connection of the base of the riser 9 to the bundles 20 running along the sea-bed, is via a bent portion of pipeline and via a connection 41 which is preferably a connection that can be fitted or activated by a remote-operated underwater vehicle.

With reference to FIG. 8, the structure of the gravity anchor intended to hold a heavy material is similar to the structure of the friction anchors described earlier, which structure essentially consists of more or less planar and undulated facets 30, together forming a cylindrical structure of octagonal cross-section, of longitudinal axis 26 vertical when in the position of use, the upper face of which is open and the lower face of which is at least partially closed; this structure delimiting the cavity 33 capable of containing a heavy material is preferably reinforced by cross members 50 arranged in a cross in one or more horizontal planes in particular.

Figure 10:
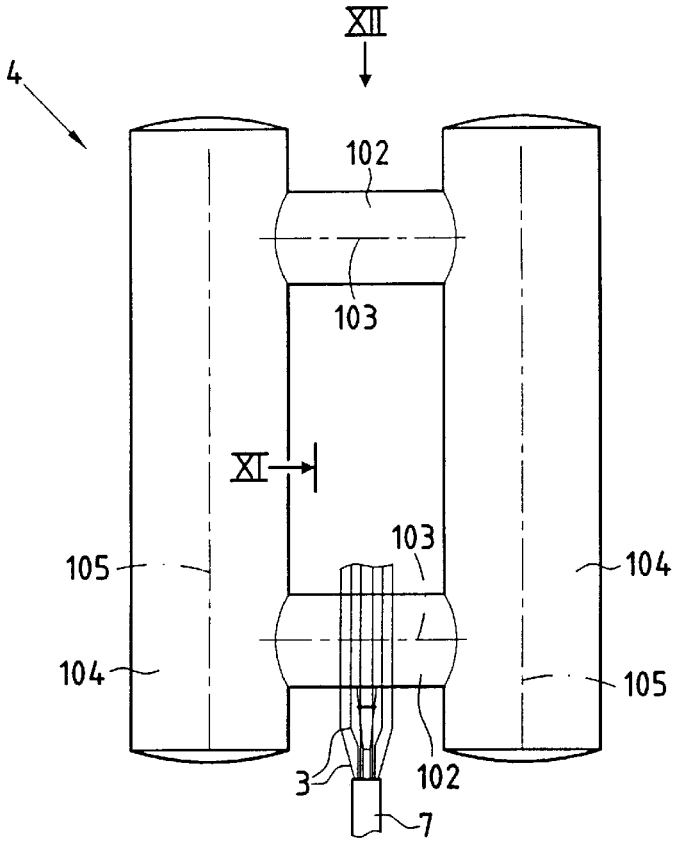

FIG. 10 illustrates, as a side view, an alternative form of a head float for a riser.

Figure 11:
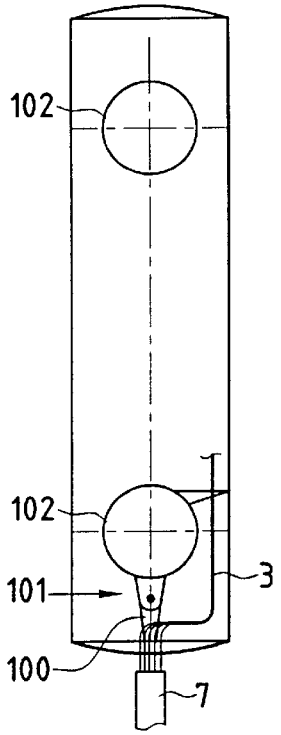
Figure 12:
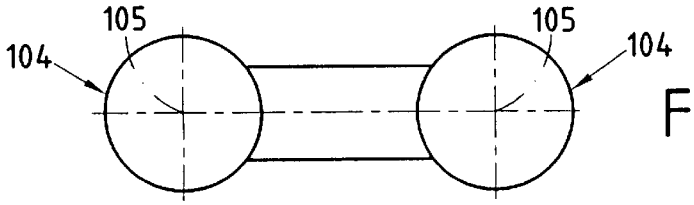

FIGS. 11 and 12 are respective views on XI and XII of FIG. 10.

Figure 13:
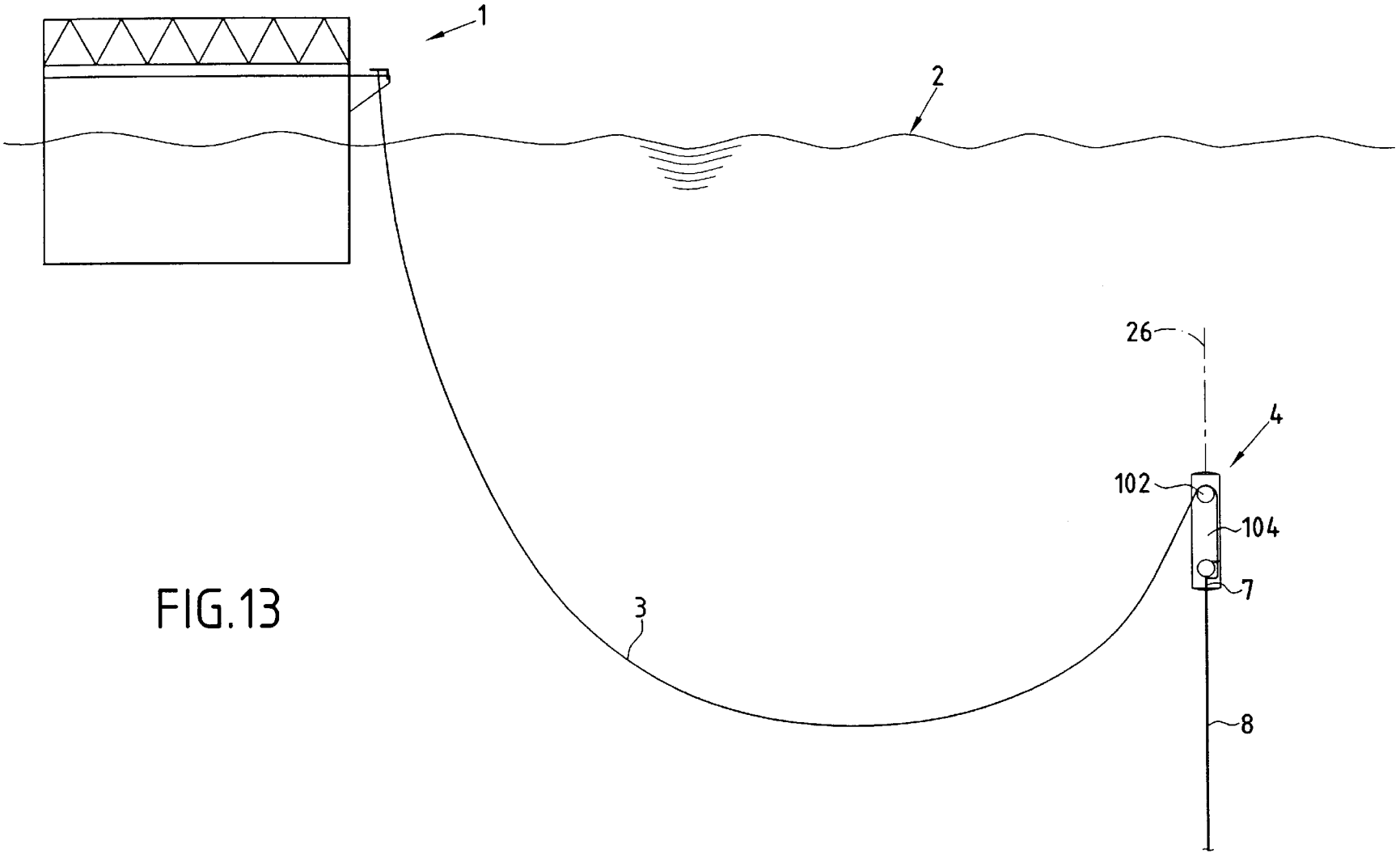

FIG. 13 illustrates the use of the float of FIGS. 10 to 12 for fastening the top end of a riser and guiding the flexible pipelines that connect the riser to the floating structure.

With reference to these FIGS. 10 to 13, the float 4 essentially consists of two cylindrical caissons 104 of mutually parallel axes 105, which are sealed at their bottom and top ends and connected by two tubular portions 102, the longitudinal axes 103 of which are mutually parallel and perpendicular to the axes 105; the lower part of the tubular length 102 situated in the bottom of FIGS. 10 and 11 has a mechanical articulation 101 such as a knuckle joint allowing the articulation, about an axis perpendicular to the plane of FIG. 11, of an arm 100 allowing the top end 7 of the riser to be attached mechanically to the float 4; in FIGS. 10 and 11, only portions of the flexible pipelines 3 are depicted; in FIG. 13 it can be seen that the top tubular portion. 102 of the float 4 illustrated in FIGS. 10 to 12 is used for guiding that part of the flexible pipelines 3 located in the vicinity of the connection with the top end of the riser 8.

Figure 14:
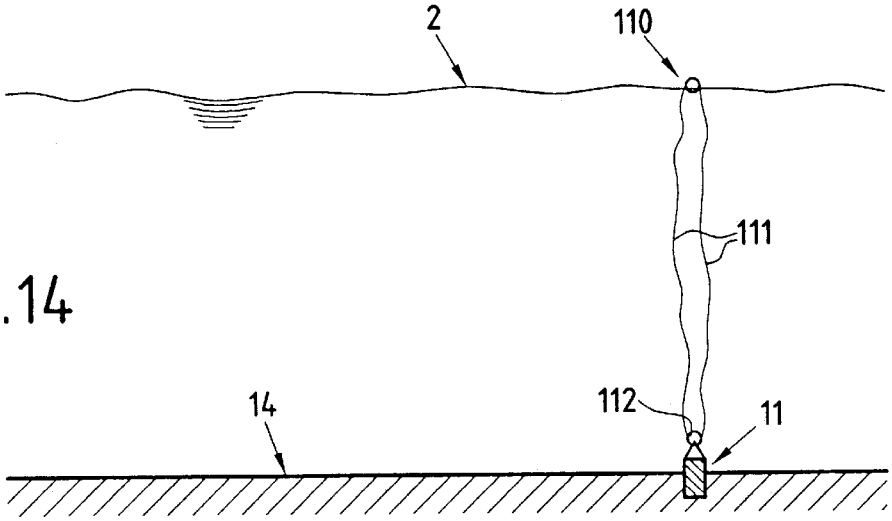
Figure 15:
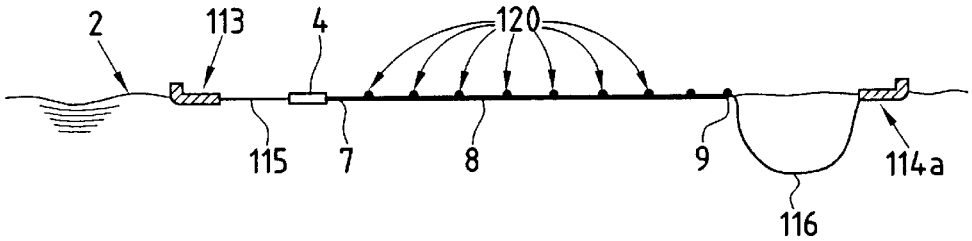
Figure 16:
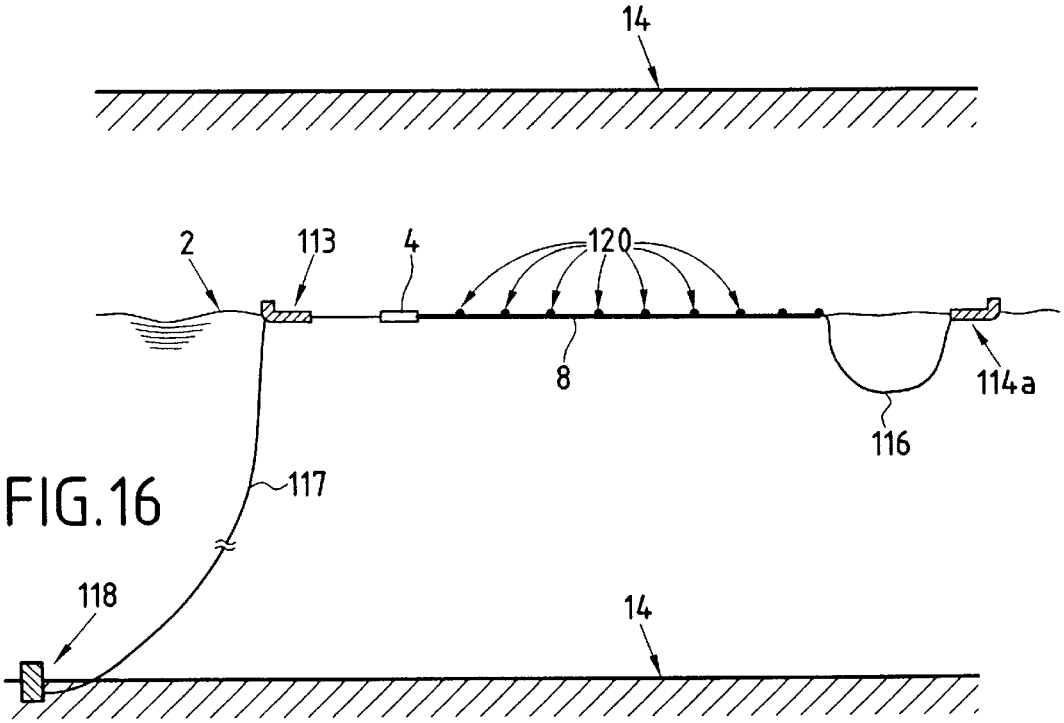
Figure 17:
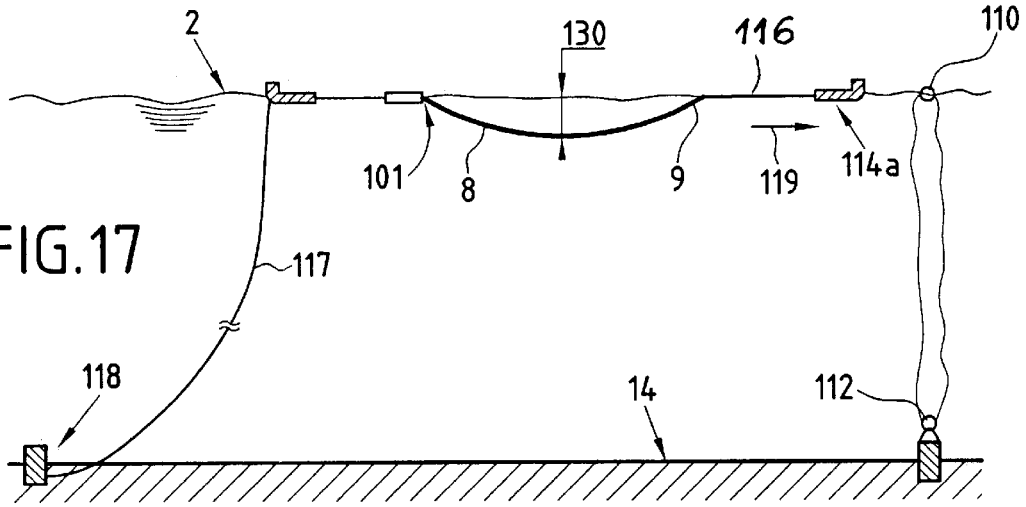
Figure 18:
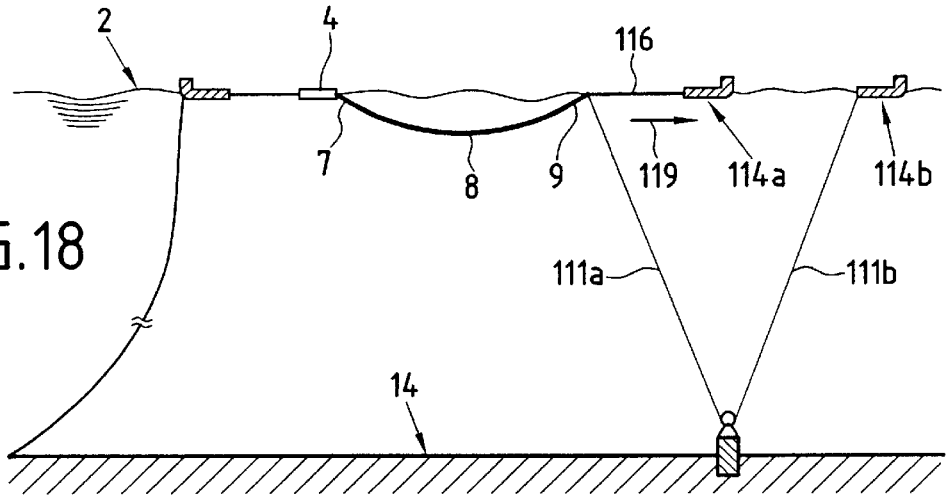

FIGS. 14 to 28 respectively illustrate successive operations of the installing of a riser and its attachment to an anchor already placed on or sunk into the sub-sea sub-soil;

FIG. 14: the anchor 11 anchored in the sub-sea sub-soil and emerging via its upper part above the sea bed 14 is fitted with a pulley 112 in which two strands of cable 111 are engaged and run up to the surface 2 where they are fixed to a buoy 110;

FIG. 15: the riser 8, secured to its float 4, is transported to the site where the anchor 11 is situated for attachment, via a towing vessel 113 connected to the float 4 by a hauling line or cable 115, and by a follow-up vessel 114*a* connected to the end 9 of the riser 8 by a is second cable 116; so that the riser 8 can be taken to the installation site, this riser is preferably temporarily equipped with buoys 120 that allow it to float on the surface 2;

FIG. 16: on the site, the towing vessel 113 is anchored to an anchor 118 which may be used later for anchoring the production floating structure 1, which anchor 118 may be a suction or friction anchor; this anchoring is via a line or cable 117;

FIG. 17: the follow-up vessel 114*a* steers towards the buoy 110 connected to the pulley 112 with which the anchor 11 is fitted, exerting a pulling force 119 on the end 9 of the riser 8, which has been detached from the buoys referenced 120 in FIGS. 2 and 3, and which therefore sinks below sea level by a height 130, for example of the order of several tens of meters;

FIG. 18: the top end of the two strands 111*a* and 111*b* previously connected to the buoy referenced 110 in FIG. 14, is connected respectively to the end 9 of the riser 8 in the case of the strand 111*a,* and to a vessel 114*b* in the case of the strand 111*b;* the end 9 of the riser 8 also remains secured to the vessel 114*a* via the line or cable 116, the paying-out of which is controlled by the vessel 114*a;*

Figure 19:
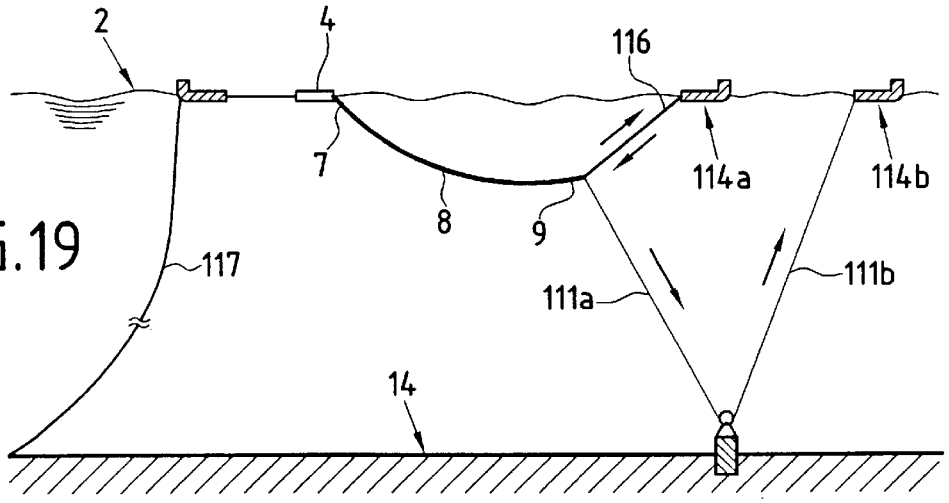
Figure 20:
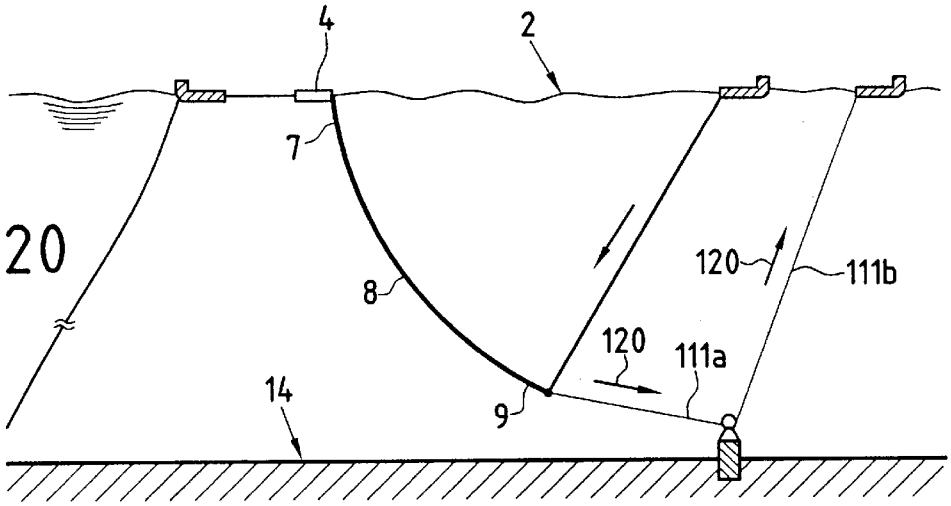
Figure 21:
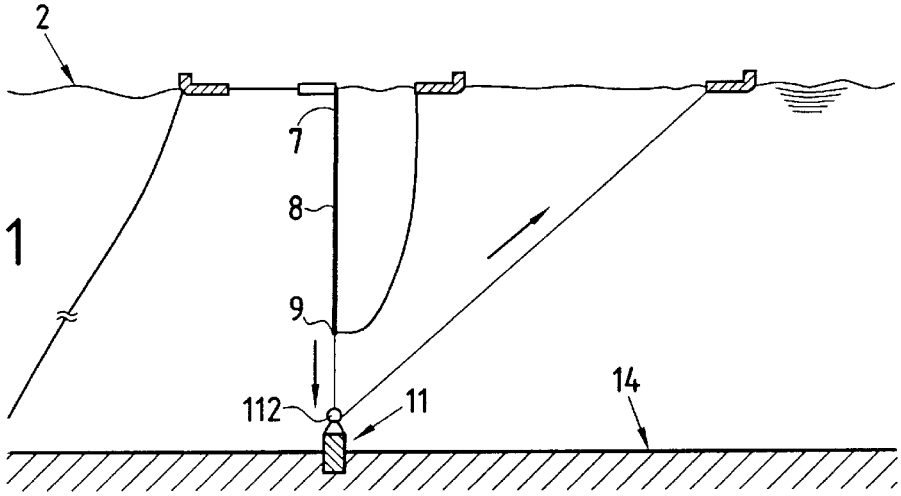
Figure 22:
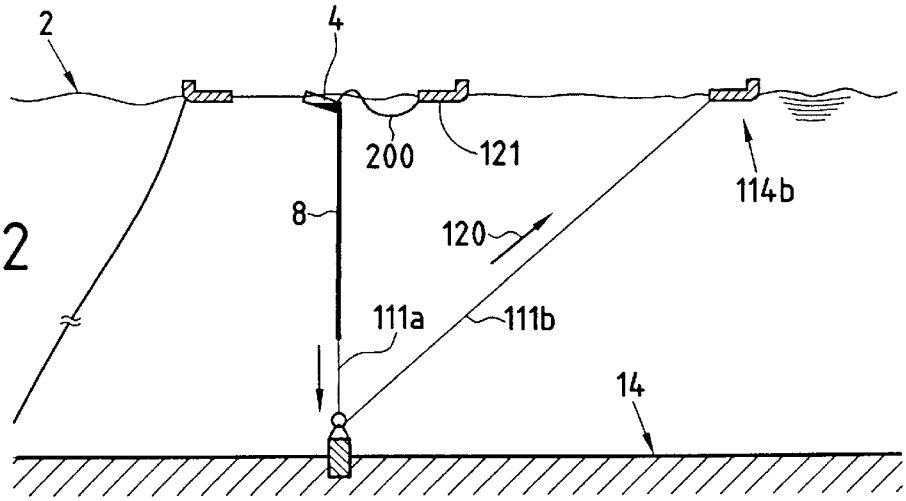
Figure 23:
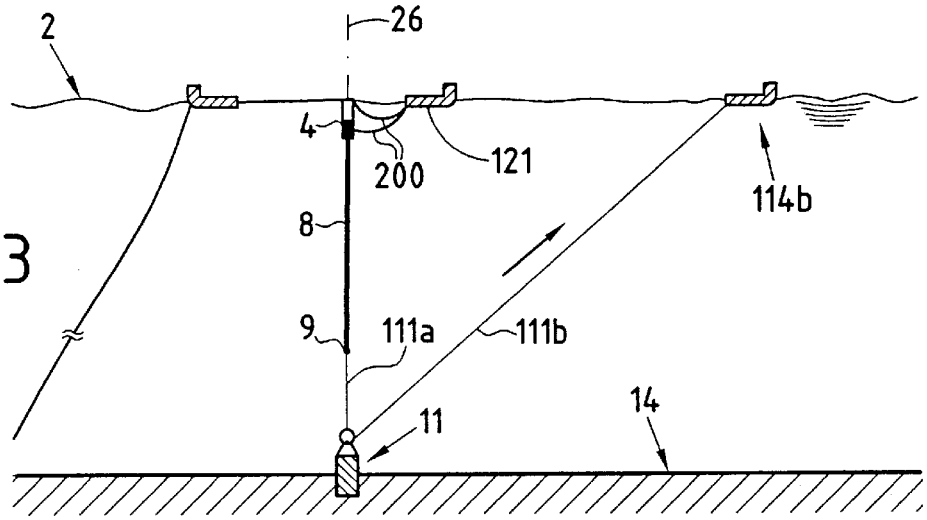
Figure 24:
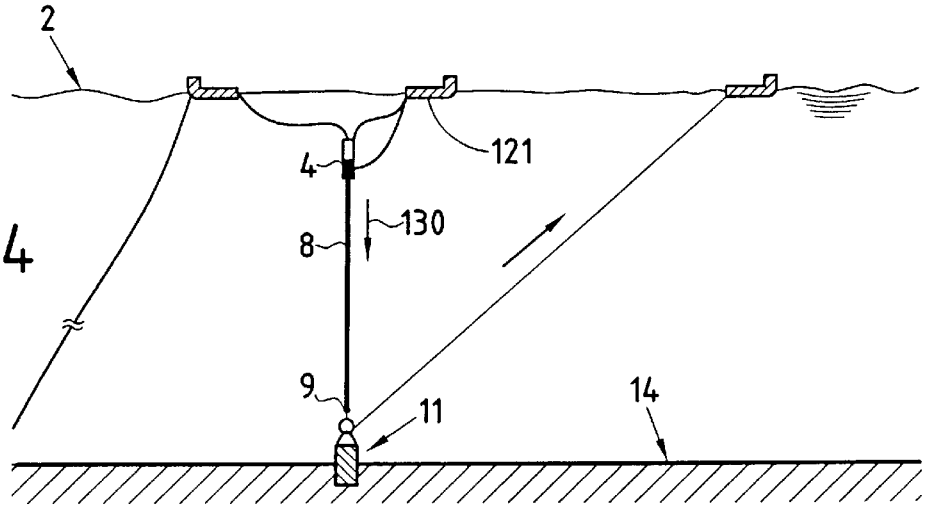
Figure 25:
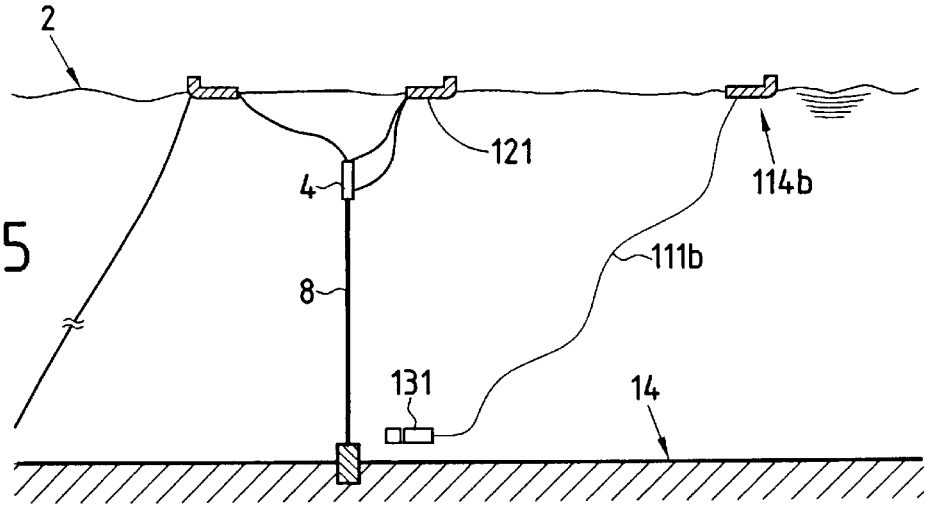
Figure 26:
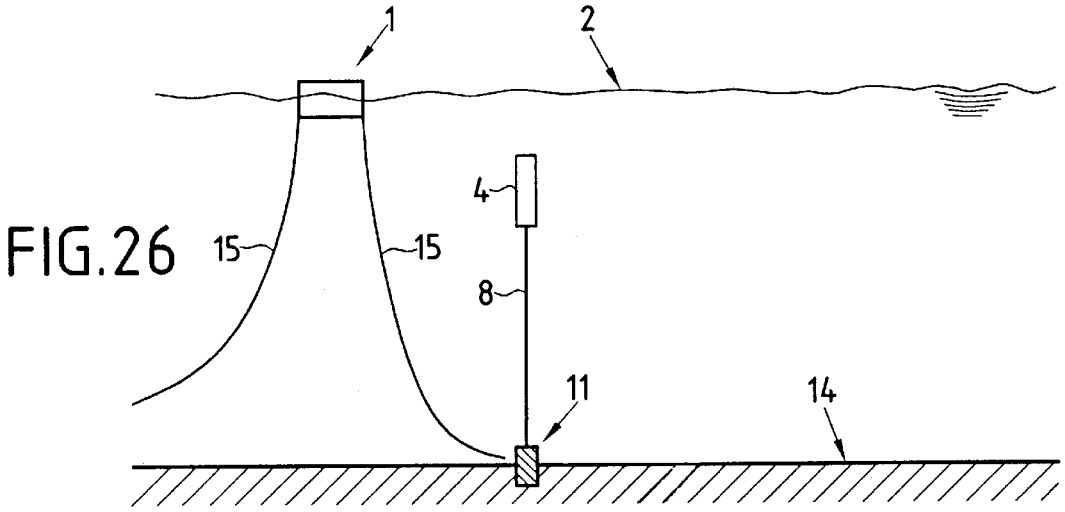
Figure 27:
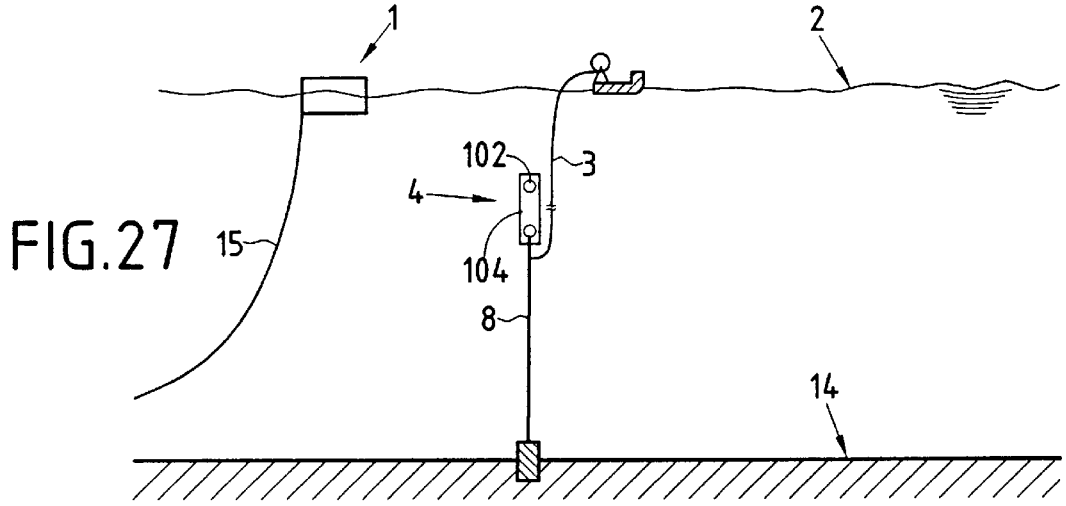
Figure 28:
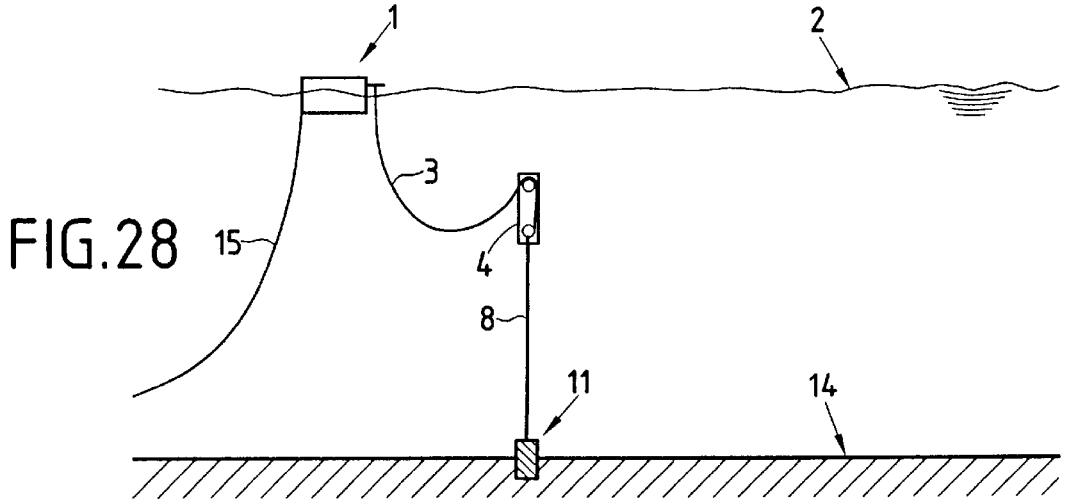
Figure 29:
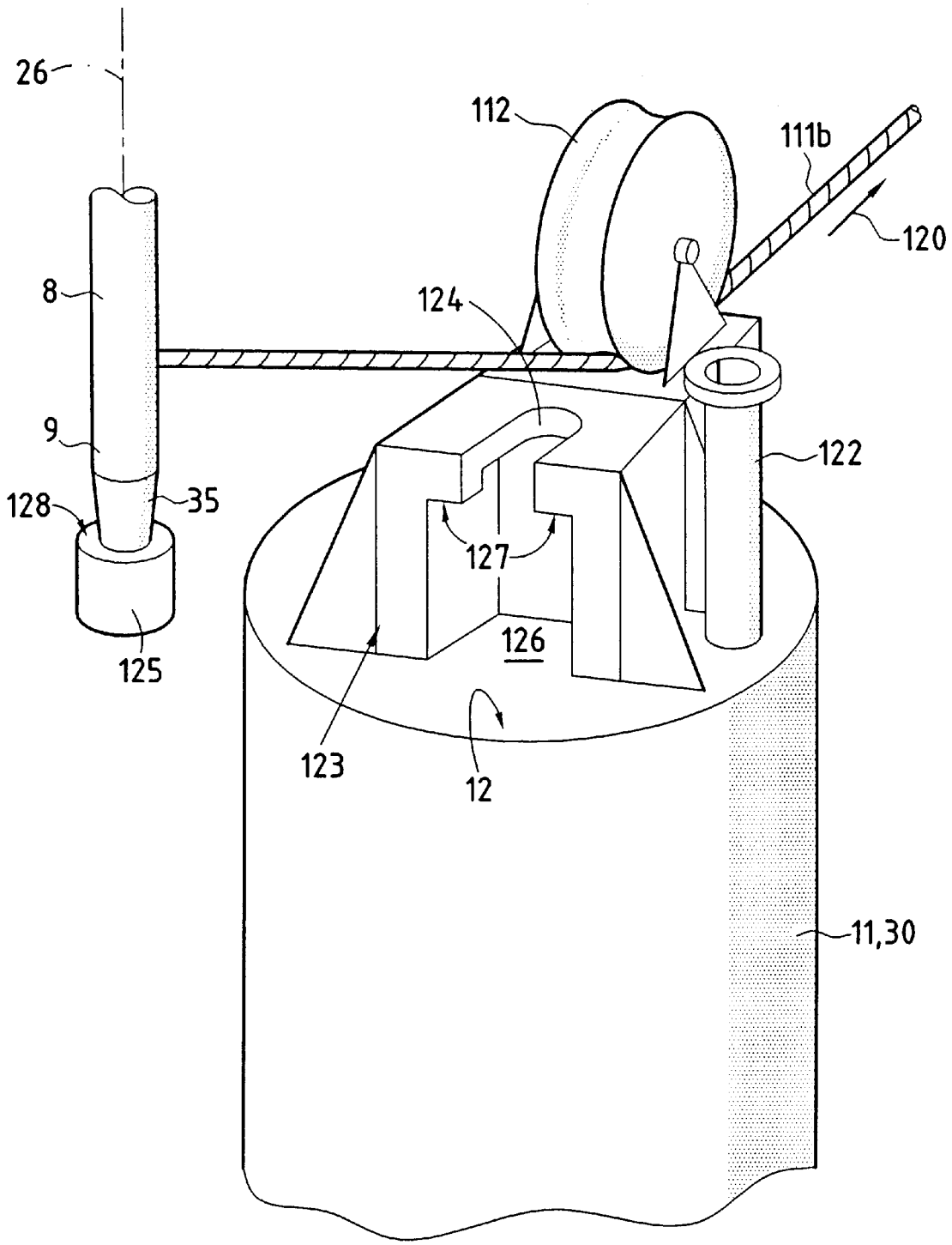

FIGS. 19 to 21: the lengthening or paying-out of the line 116 by the vessel 114*a* and the simultaneous pulling of the strand 111*b* by the vessel 114*b,* cause uniform and controlled submerging of the lower end 9 of the riser 8, the end 7 of which remains on the surface by virtue of the float 4 (to which it is connected by the articulated connection 100, 101), until the riser 8 is in a position stretched out along a vertical axis as illustrated in FIG. 21;

FIGS. 22 to 25: a ship 121 equipped with pumps to allow the float 4 to be filled with and emptied of water, is connected for this purpose by pipelines and cables 200; the float 4 is gradually and partially filled with water so that it inclines and sinks, allowing the lowering of the riser 8, the lower end 9 of which remains guided in the direction of the anchor 11 by virtue of the action of the lines 111*a,* 111*b* attached to its bottom end 9 and pulled simultaneously by the vessel 114*b* in the direction of the arrows 120 until the bottom end 9 of the riser 8 is more or less in contact with the top of the anchor 11 intended to receive the riser, which corresponds to the configuration depicted in FIGS. 24, 25 and 29;

FIGS. 26 to 28: it is then possible, as illustrated in these figures, having detached the cables 111*a,* 111*b* from the anchor 11, for example using a remote-operated underwater vehicle 131, to engage the bottom end 9 of the riser 8 in the connection means provided at the top of the anchor 11, particularly as depicted on a larger scale in FIG. 29; as illustrated in FIGS. 27 and 28, it is then possible to connect the flexible pipelines 3, first of all to the top end of the transport pipelines provided in the riser 8, as illustrated in FIG. 27, and then to connect these flexible pipelines 3 to the storage and production surface structure 1.

With reference to FIG. 29, the bottom end 9 of the riser 8 may be fitted with a pivot 125 provided at the bottom end of a connection piece 35, which pivot 125 has a part which protrudes from the piece 35 and has bearing faces 128, capable of coming opposite faces 127 of a connecting piece provided at the top part 12 of the anchor 11, which connecting piece delimits an opening or notch 124, inside which the part 35 of the connecting means can be engaged through a movement of more or less horizontal translation, while the pivot or stud 125 engages in the cavity 126 that extends under the opening or notch 124; as illustrated in this FIG. 29, the anchor 11 is provided in its top with a pipe 122 for temporary connection to a pump allowing the cavity delimited by the bell-shaped anchor 11 to be partially evacuated.

FIG. 29 illustrates, in diagrammatic perspective, the base of the riser and the top of an anchor, before they are secured together.

Said syntactic material, which is made up of microspheres or macrospheres in a matrix of plastic resin such as epoxy resin, polyurethane resin or polypropylene resin, can be obtained from plastics traders and manufacturers suchc as BTMI (france), Balmoral Marine (UK), or Emerson Cuming (USA).

What is claimed is:

1. A device for transporting petroleum products in deep waters, from the sea bed up to a floating or semi-submersible surface structure, which comprises:

at least one rigid and straight hybrid riser extending vertically, said hybrid riser having a top and bottom said hybrid riser comprising a rigid central hollow tubular structure surrounded by syntactic material providing buoyancy for the riser and acting as thermal insulation and a plurality of rigid pipelines surrounding said central tubular structure, said rigid pipelines being embedded in said syntactic material and extending therealong for transporting petroleum products, an anchor fixing the bottom of the riser to the sub-sea sub-soil, a submerged float fixed to the top of the riser and exerting on the riser an upwards vertical force, and flexible pipelines for connecting said rigid pipelines to said floating or semi-submersible structure.

2. A device according to claim 1, wherein said riser is fixed to said anchor by a disconnectable connection.

3. A device according to claim 2, wherein said disconnectable connection provides a rigid attachment.

4. A device according to claim 2, wherein said disconnectable connection includes an articulated attachment.

5. A device according to claim 1, comprising an articulated connection between the top of the riser and the float.

6. A device according to claim 1 wherein said anchor comprises a shell of cylindrical shape and of polygonal cross-section.

7. A device according to claim 1, wherein said anchor has peripheral walls with internal and external faces each having an area between 100 and 1000 $m^2$.

8. A device according to claim 1, wherein said float comprises two cylindrical caissons connected by two tubular portions.

9. A device according to claim 1, wherein said anchor is a suction anchor.

10. A device according to claim 1, comprising a plurality of further pipelines radiating outwardly from said riser and connected to said pipelines in said riser.

11. A device according to claim 1, wherein said syntactic material is in the form of a cylindrical block concentrically surrounding said rigid, hollow, tubular structure.

* * * * *